United States Patent [19]

Paull et al.

[11] 4,099,382

[45] Jul. 11, 1978

[54] BY-PRODUCT SUPERHEATED STEAM FROM THE PARTIAL OXIDATION PROCESS

[75] Inventors: Peter L. Paull, Weston, Conn.; Rodney McGann, Northridge, Calif.

[73] Assignee: Texaco Inc., New York, N.Y.

[21] Appl. No.: 698,439

[22] Filed: Jun. 21, 1976

[51] Int. Cl.[2] ..... F01K 27/00

[52] U.S. Cl. ..... 60/648; 48/197 R; 48/215; 252/373

[58] Field of Search ..... 48/197 R, 215; 60/648, 60/670, 655, 39.12; 252/373

[56] References Cited

U.S. PATENT DOCUMENTS

| | | | |
|---|---|---|---|
| 1,951,990 | 3/1934 | Noack | 48/197 R |
| 2,593,963 | 4/1952 | Biggs | 60/655 |
| 3,002,347 | 10/1961 | Sprague | 60/39.12 |
| 3,715,301 | 2/1973 | Tassoney et al. | 48/197 R |
| 3,866,411 | 2/1975 | Marion et al. | 48/215 X |
| 3,922,148 | 11/1975 | Child | 48/197 R |

FOREIGN PATENT DOCUMENTS

| | | | |
|---|---|---|---|
| 740,197 | 11/1955 | United Kingdom | 60/655 |

*Primary Examiner*—Allen M. Ostrager
*Assistant Examiner*—Stephen F. Husar
*Attorney, Agent, or Firm*—Thomas H. Whaley; Carl G. Ries; Albert Brent

[57] ABSTRACT

Sensible heat in the hot effluent gas stream leaving a partial oxidation gas generator for the production of raw synthesis gas, reducing gas, or fuel gas is used at its maximum temperature to produce a continuous stream of superheated steam at a pressure which may exceed the pressure in the gas generator. The by-product superheated steam may be used as a dispersant or carrier of the fuel feed to the generator or as a temperature moderator. Optionally, a portion of the by-product superheated steam may be used as the working fluid in a turbine to produce mechanical work or electrical energy or both. The high steam superheat temperature results in a higher conversion efficiency.

45 Claims, 2 Drawing Figures

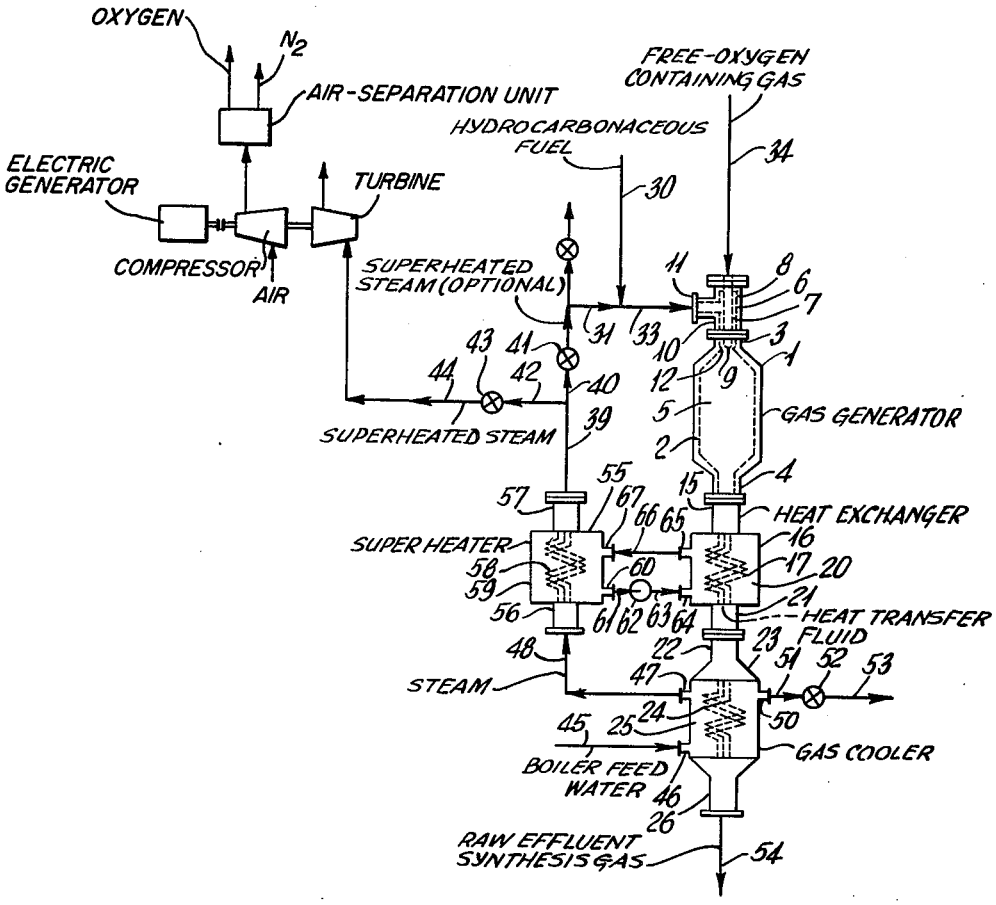

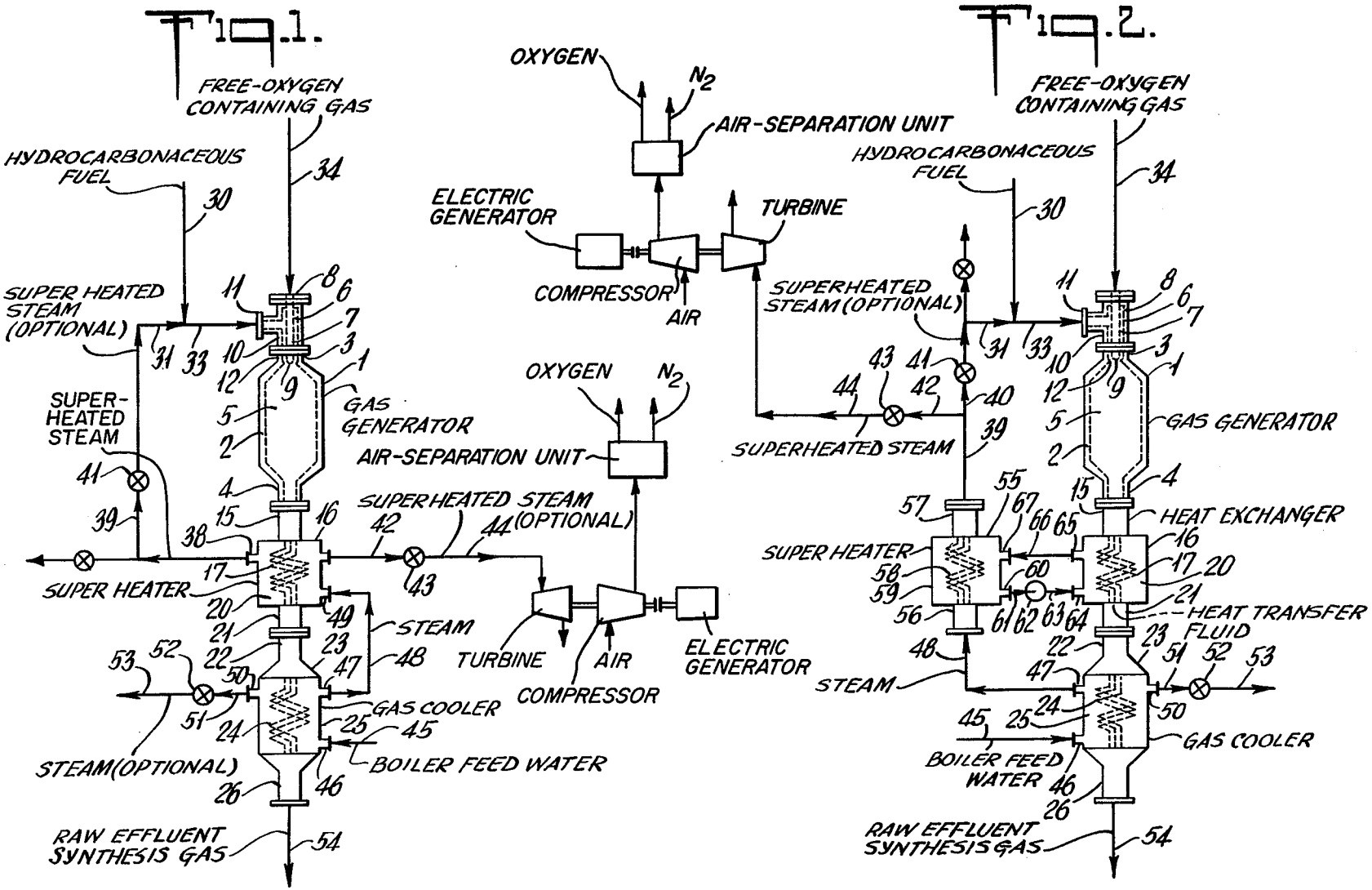
Fig. 2.
FREE-OXYGEN CONTAINING GAS
HYDROCARBONACEOUS FUEL
GAS GENERATOR
HEAT EXCHANGER
HEAT TRANSFER FLUID
GAS COOLER
SUPERHEATED STEAM (OPTIONAL)
SUPERHEATED STEAM
SUPER HEATER
STEAM
BOILER FEED WATER
RAW EFFLUENT SYNTHESIS GAS
AIR-SEPARATION UNIT
TURBINE
COMPRESSOR
AIR
ELECTRIC GENERATOR
OXYGEN
$N_2$
Fig. 1.
FREE-OXYGEN CONTAINING GAS
HYDROCARBONACEOUS FUEL
SUPER HEATED STEAM (OPTIONAL)
SUPER-HEATED STEAM
GAS GENERATOR
SUPER HEATER
AIR-SEPARATION UNIT
SUPERHEATED STEAM (OPTIONAL)
STEAM
TURBINE
COMPRESSOR
AIR
ELECTRIC GENERATOR
GAS COOLER
BOILER FEED WATER
STEAM (OPTIONAL)
RAW EFFLUENT SYNTHESIS GAS
OXYGEN
$N_2$

BY-PRODUCT SUPERHEATED STEAM FROM THE PARTIAL OXIDATION PROCESS

BACKGROUND OF THE INVENTION

1. Field of the Invention

This invention pertains to a partial oxidation process for making synthesis gas, fuel gas, or reducing gas along with by-product superheated steam.

2. Description of the Prior Art

In the partial oxidation process, the effluent gas stream leaving the gas generator at a temperature in the range of about 1500° to 3000° F. must be cooled below the equilibrium temperature for the desired gas composition. This is presently done by quenching the effluent gas stream in water, or by cooling the gas stream in a gas cooler, thereby producing saturated steam. Both of these methods of gas cooling result in large increases in entropy and reduced thermal efficiencies. This problem is partially overcome in the subject process by the production of by-product superheated steam from heat extracted from the hot effluent gas stream leaving the partial oxidation gas generator at its maximum temperature.

Production of saturated steam, but not superheated steam is described in coassigned U.S. Pat. No. 3,528,930 — W. G. Schlinger et al.

SUMMARY

A continuous stream of superheated steam is produced as a valuable by-product during the partial oxidation of a hydrocarbonaceous fuel, oxygenated hydrocarbonaceous fuel, or slurries of solid carbonaceous fuel to produce synthesis gas, fuel gas, or reducing gas. At least a portion of said superheated steam may be continuously recycled to the gas generator as a dispersant or carrier for the fuel, or as a temperature moderator. Optionally, at least a portion of said by-product superheated steam may be continuously introduced into a steam turbine as the working fluid to produce mechanical work or electrical energy. The high steam superheat temperature results in a higer conversion efficiency. In the process, a continuous hot effluent gas stream from a partial oxidation gas generator is passed successively through first and second heat exchange zones in series. A continuous stream of steam may be produced in the second heat exchange zone i.e. in a gas cooler. Then in the first heat exchange zone the stream of steam is converted into a continuous stream of superheated steam by heat exchange with the stream of hot effluent gas leaving the gas generator. One embodiment of the process involves three heat exchange zones. In a first heat exchanger, a continuous stream of heat transfer fluid picks up a portion of the sensible heat in the stream of hot effluent gas leaving the gas generator. The heated heat exchange fluid is then continuously introduced into a superheater in heat exchange with a continuous stream of steam. The steam was previously produced in a second heat exchanger by heat exchange between water and the effluent gas stream leaving the first heat exchanger. A continuous stream of superheated steam may be removed from the superheater for use in the process or for export. Advantageously, the superheated steam may be at a pressure which is greater than that in the gas generator.

BRIEF DESCRIPTION OF THE DRAWING

The invention will be further understood by reference to the accompanying drawing in which FIG. 1 is a schematic representation of a preferred embodiment of the process.

FIG. 2 is a representation of another embodiment of the process.

DESCRIPTION OF THE INVENTION

The present invention pertains to an improved continuous partial oxidation gasification process for producing raw synthesis gas, reducing gas, or fuel gas along with valuable by-product superheated steam. The aforesaid gas streams comprise $H_2$, CO, and at least one member of the group $H_2O$, $CO_2$, $H_2S$, COS, $CH_4$, $N_2$, A, and particulate carbon.

In the subject process, a continuous effluent gas stream of synthesis gas, reducing gas or fuel gas is produced in the refractory lined reaction zone of a separate free-flow unpacked noncatalytic partial oxidation fuel gas generator. The gas generator is preferably a vertical steel pressure vessel, such as shown in the drawing and described in co-assigned U.S. Pat. No. 2,992,906 issued to F. E. Guptill, Jr.

A wide range of combustible carbon containing organic materials may be reacted in the gas generator with a free-oxygen containing gas optionally in the presence of a temperature moderating gas to produce said effluent gas stream.

The term hydrocarbonaceous is used herein to describe various suitable feedstocks to the partial oxidation gas generator is intended to include gaseous, liquid, and solid hydrocarbons, carbonaceous materials, and mixtures thereof. In fact, substantially any combustible carbon containing organic material, fossil fuel, or slurries thereof, may be included within the definition of the term "hydrocarbonaceous". For example, there are (1) pumpable slurries of solid carbonaceous fuels, such as coal, lignite, particulate carbon, petroleum coke, concentrated sewer sludge, and mixtures thereof; (2) gas-solid suspensions, such as finely ground solid carbonaceous fuels dispersed in either a temperature moderating gas or in a gaseous hydrocarbon; and (3) gas-liquid-solid dispersions, such as atomized liquid hydrocarbon fuel or water and particulate carbon dispersed in a temperature-moderating gas. The hydrocarbonaceous fuel may have a sulfur content in the range of about 0 to 10 weight percent and an ash content in the range of about 0 to 15 weight percent.

The term liquid hydrocarbon, as used herein to describe suitable liquid feedstocks, is intended to include various materials, such as liquefied petroleum gas, petroleum distillates and residues, gasoline, naphtha, kerosine, crude petroleum, asphalt, gas oil, residual oil, tar-sand oil and shale oil, coal derived oil, aromatic hydrocarbon (such as benzene, toluene, xylene fractions), coal tar, cycle gas oil from fluid-catalytic-cracking operation, furfural extract of coker gas oil, and mixtures thereof. Gaseous hydrocarbon fuels, as used herein to describe suitable gaseous feedstocks, include methane, ethane, propane, butane, pentane, natural gas, water-gas, coke-oven gas, refinery gas, acetylene tail gas, ethylene off-gas, synthesis gas, and mixtures thereof. Both gaseous and liquid feeds may be mixed and used simultaneously, and may include paraffinic, olefinic, naphthenic, and aromatic compounds in any proportion.

Also included within the definition of the term hydrocarbonaceous are oxygenated hydrocarbonaceous organic materials including carbohydrates, cellulosic materials, aldehydes, organic acids, alcohols, ketones, oxygenated fuel oil, waste liquids and by products from chemical processes containing oxygenated hydrocarbonaceous organic materials and mixtures thereof.

The hydrocarbonaceous feed may be at room temperature or it may be preheated to a temperature up to as high as about 600° F. to 1,200° F., say 800° F. but preferably below its cracking temperature. Preheating the hydrocarbonaceous feed may be accomplished by non-contact heat exchange or direct contact with by-product superheated or saturated steam produced in the subject process. The hydrocarbonaceous feed may be introduced into the burner in liquid phase or in a vaporized mixture with a temperature moderator. Suitable temperature moderators include superheated steam, saturated steam, unsaturated steam, water, $CO_2$-rich gas, a portion of the cooled exhaust from a turbine employed downstream in the process, nitrogen in air, by-product nitrogen from a conventional air separation unit, and mixtures of the aforesaid temperature moderators.

The use of a temperature moderator to moderate the temperature in the reaction zone depends in general on the carbon to hydrogen ratio of the feedstock and the oxygen content of the oxidant stream. A temperature moderator may not be required with some gaseous hydrocarbon fuels, however, generally, one is used with liquid hydrocarbon fuels and with substantially pure oxygen. The temperature moderator may be introduced in admixture with either or both reactant streams. Alternatively, the temperature moderator may be introduced into the reaction zone of the gas generator by way of a separate conduit in the fuel burner.

From about 0 to 100% of the superheated steam produced subsequently in the subject process may be used to preheat and disperse the liquid hydrocarbonaceous feed, or to preheat and entrain the solid carbonaceous fuels that may be introduced into the gas generator.

The weight ratio of total amount of $H_2O$ to fuel introduced into the reaction zone of the gas generator is in the range of about 0 to 5.

When comparatively small amounts of $H_2O$ are charged to the reaction zone, for example through the burner to cool the burner tip, the $H_20$ may be mixed with either the hydrocarbonaceous feedstock, the free-oxygen containing gas, the temperature moderator, or combination thereof. In such case, the weight ratio of water to hydrocarbonaceous feed may be in the range of about 0.0 to 1.0 and preferably 0.0 to less than 0.2.

The term free-oxygen containing gas, as used herein is intended to include air, oxygen-enriched air, i.e. greater than 21 mole % oxygen, and substantially pure oxygen, i.e. greater than 95 mole % oxygen, (the remainder comprising $N_2$ and rare gases). Free-oxygen containing gas may be introduced into the burner at a temperature in the range of about ambient to 1,800° F. The ratio of free oxygen in the oxidant to carbon in the feedstock (O/C, atom/atom) is preferably in the range of about 0.7 to 1.5.

The feedstreams are introduced into the reaction zone of the fuel gas generator by means of fuel burner. Suitably, an annulus-type burner, such as described in coassigned U.S. Pat. No. 2,928,460 issued to DuBois Eastman et al., may be employed.

The feedstreams are reacted by partial oxidation without a catalyst in the reaction zone of a free-flow gas generator at an autogenous temperature in the range of about 1500° F. to 3500° F. and at a pressure in the range of about 1 to 250 atmospheres absolute (atm. abs.). The reaction time in the fuel gas generator is about 1 to 10 seconds. The effluent stream of gas leaving the gas generator may comprise CO, $H_2$, $CO_2$, $H_2O$, $CH_4$, $N_2$, A, $H_2S$ and COS. Unreacted particulate carbon (on the basis of carbon in the feed by weight) is about 0.2 to 20 weight percent from liquid feeds but is usually negligible from gaseous hydrocarbon feeds. The specific composition of the effluent gas is dependent on actual operating conditions and feedstreams. Synthesis gas substantially comprises $H_2+CO$; all or most of the $H_2O$ and $CO_2$ are removed for reducing gas; and the $CH_4$ content may be maximized for fuel gas.

Preheating the hydrocarbonaceous feed may be accomplished by non-contact heat exchange or direct contact with by-product superheated, saturated, or unsaturated steam as produced in the subject process.

A continuous stream of hot effluent gas, at substantially the same temperature and pressure as in the reaction zone leaves from the axial exit port of the gas generator and is then introduced directly to a first heat exchange zone. Optionally, a solids separation zone (not shown in the drawing) may be inserted between the exit port of the gas generator and said first heat exchange zone. The solids separation zone may comprise a free-flow catch-pot i.e. slag chamber which may be inserted in the line before the first heat exchanger. By this means at least a portion of any solid matter i.e. particulate carbon, ash, slag, refractory, and mixtures thereof that may be entrained in the hot effluent gas stream, or which may flow from the gas generator i.e. slag, ash, bits of refractory, may be separated from the effluent gas stream and recovered with very little, if any, pressure drop in the line. A typical slag chamber that may be employed is shown in FIG. 1 of the drawing for coassigned U.S. Pat. No. 3,528,930. Thus in the subject process carbon from the effluent gas stream, scale, and solidified slag or ash from the fuel and refractory may be withdrawn periodically from a solids separation zone, such as from the lowermost portion of the slag-accumulation zone 23 in U.S. Pat. No. 3,528,930.

A portion of the sensible heat in the effluent gas stream leaving the gas generator or the solids separation zone is recovered in a first heat exchange zone. This heat is used to convert steam produced elsewhere in the process into superheated steam at a pressure above the pressure in the gas generator. As shown in the drawing, in FIG. 1, the superheated steam in lines 39 and 42 is produced in heat exchanger 16 by heat exchange between the effluent gas stream from the gas generator and steam. In FIG. 2, the superheated steam in line 39 is produced in heat exchanger 55 by heat exchange between a heat transfer fluid and steam. The heat transfer fluid was previously heated in heat exchanger 16 by heat exchange with the effluent gas stream from the gas generator.

In FIG. 1 of the drawing, the hot effluent gas stream from the generator passes in noncontact heat exchange with a stream of steam produced in a second heat exchange zone located immediately downstream. By definition, the word "noncontact" means that there is no mixing between the two gas streams. Preferably, these two streams run in opposite directions i.e. indirect flow. However, they may run in the same direction i.e. direct flow. In FIG. 1 there is depicted a conventional shell and tube heat exchanger 16 with steam entering the shell side and leaving superheated, and with the hot effluent gas stream passing through tubes or multiple coils. This arrangement of streams may be reversed, and the hot effluent gas stream may flow on the shell side. Any suitable heat exchanger that is capable of withstanding the temperatures and pressures of the fluids may be used. Heat resistant metals and ceramics may be employed as construction materials.

The stream of steam to be converted into superheated steam enters the first heat exchanger at a temperature in the range of about 298° to 705° F., and a pressure in the range of about 65 to 3800 psia. The superheated steam leaves the first heat exchanger at a temperature in the range of about 750° to 1100° F. and a pressure in the range of about 65 psia to 3800 psia. Advantageously, the superheated steam may be produced at a pressure which is greater than the pressure in the reaction zone of the gas generator. The high steam superheat temperature results in a high conversion efficiency when said superheated steam is employed as the working fluid in an expansion turbine for producing mechanical power or electrical energy. The hot effluent gas stream from the gas generator or solids separation zone at substantially the same temperature and pressure as in the reaction zone enters the first heat exchanger at a temperature in the range of about 1500° F. to 3500° F. and a pressure in the range of about 1 to 250 atm. abs., such as 50 to 3750 psia.

The partially cooled effluent gas stream may leave the first heat exchange zone at a temperature in the range of about 600° F. to 2600° F. and a pressure in the range of about 50 to 3735 psia and enters a second heat exchange zone i.e. gas cooler 23 with substantially no reduction in temperature and pressure where it passes in noncontact heat exchange with boiler feed water.

The raw effluent gas stream leaves said second heat exchange zone at a temperature in the range of about 320° to 700° F. and a pressure which is substantially the same as in the reaction zone of the gas generator less ordinary pressure drop in the lines, any solids removal zone, and first and second heat exchange zones i.e. total pressure drop may be about 2 atmospheres absolute or less. The raw effluent gas stream may comprise in mole % $H_2$ 70 to 10, CO 15 to 57, $CO_2$ 0 to 5, $H_2O$ 0 to 20, $N_2$ 0 to 75, A 0 to 1.0, $CH_4$ 0 to 25, $H_2S$ 0 to 2.0, and COS 0 to 0.1. Unreacted particulate carbon (on the basis of carbon in the feed by weight) may be about nil to 20 weight percent. Optionally, the raw effluent gas stream leaving the second heat exchange zone may be sent to conventional gas cleaning and purification zones downstream where unwanted constituents may be removed.

The boiler feed water enters the second heat exchange zone at a temperature in the range of about ambient to 675° F. and leaves as unsaturated or saturated steam at a temperature of about 298°–705° F. to 65–3800 psia. Advantageously, the unsaturated or saturated steam may be produced at a pressure which is greater than the pressure in the reaction zone of the gas generator. While indirect flow is preferred in the second heat exchanger 23, as shown in FIG. 1, direct flow may be employed. Further, in another embodiment, the stream of steam may be produced in the tubes while the effluent gas stream is passed through the shell side.

From about 0 to 100 weight percent of the steam produced in the second heat exchange zone is passed into the first heat exchange zone to produce superheated steam having a pressure greater than the pressure in the gas generator. Optionally, a portion of the steam may be used elsewhere in the process or exported. Superheated, saturated, or unsaturated steam produced in the process may be used to provide heat. For example steam may be used to preheat the feedstreams to the gas generator. In this manner, hydrocarbonaceous fuel may be preheated to a temperature up to about 800° F. but below its cracking temperature with at least a portion of the steam produced by the subject process. It may also be used in the gas generator as a temperature moderator.

At least a portion of the by-product superheated steam produced by the subject process may be introduced into the partial oxidation gas generator where it may react and thereby contribute to the amount of hydrogen in the effluent gas stream. Further, the thermal efficiency of the process is improved. Condensation problems that may result when steam and hydrocarbonaceous fuels are mixed together may be avoided by using superheated steam. Advantageously, a portion of the superheated steam may be used as the working fluid in a turbocompressor to compress air feed to an air separation unit for producing substantially pure oxygen (95 mole % or more). At least a portion of this oxygen may be introduced into the gas generator as the oxidant reactant. The superheated steam may also be used as the working fluid in a turboelectric generator. Starting with superheated steam at a very high temperature level and converting the heat into electricity favourably affects the conversion efficiency.

Heat exchange zones 1 and 2 are shown in FIG. 1 of the drawing preferably as two separate heat exchangers 16 and 23 that are joined together. The advantages of this scheme are to simplify the design and reduce the size of each heat exchanger thereby reducing equipment costs. Heat exchange units of conventional design may be assembled. System down-time may be minimized in case one of the units has to be replaced for maintenance or repair. In another embodiment, heat exchange zones 1 and 2 may be contained in a common shell.

Another embodiment of the invention is shown in FIG. 2 of the drawing. There the hot effluent gas stream from the gas generator or, optionally, from a free-flow solids, slag, or both separation zone and at substantially the same temperature and pressure as that in the reaction zone enters the first heat exchanger 16 at a temperature in the range of about 1500° F. to 3500° F. and a pressure in the range of about 50 to 3750 psia. The solids or slag separation zone is not shown in the drawing. By offering substantially no obstruction to the free-flow of the effluent gas stream, the solids separator provides substantially no pressure drop in the line. The effluent gas stream passes in noncontact heat exchange with a comparatively cooler heat transfer fluid which is thereby raised to a temperature in the range of about 1800° to 2800° F. Simultaneously, the effluent gas stream is cooled and leaves the first heat exchange zone at a temperature in the range of about 600° F. to 2600° F. and a pressure in the range of about 40 to 3735 psia and directly enters a second heat exchange zone i.e. gas cooler 23 at substantially the same exit temperature and pressure from heat exchanger 16. In gas cooler 23 the effluent gas stream passes in noncontact heat exchange with boiler feed water. The boiler feed water enters at a temperature in the range of about ambient to 675° F. and leaves as saturated or unsaturated steam at a temperature of about 298° to 705° F. and a pressure of about 65 to 3800 psia. Advantageously, the saturated or unsaturated steam may be produced at a pressure which is greater than the pressure in the reaction zone of the gas generator. The effluent gas stream leaves gas cooler 23 at a temperature in the range of about 320° to 700° F. and at a pressure which is about the same as in the reaction zone of the gas generator less ordinary pressure drop in the lines and vessels.

Simultaneously, with the heat exchange going on in heat exchangers 16 and 23, a continuous stream of superheated steam at a temperature in the range of about 750° to 1100° F. and a pressure in the range of about 65 to 3800 psia is produced in a third heat exchange zone i.e. heat exchanger 55 by noncontact heat exchange between a continuous stream of steam from the previously described second heat exchange zone 23 and a continuous stream of said heat transfer fluid from said first heat exchange zone 16. Advantageously, the superheated steam may be produced with a pressure that is greater than the pressure in the reaction zone of the gas generator. The heat transfer fluid enters heat exchanger 55 from heat exchanger 16 at a temperature in the range of about 1800° to 2800° F., leaves heat exchanger 55 at a temperature in the range of 850° to 2200° F., and at substantially the same temperature is circulated into heat exchanger 16, where it passes in noncontact heat exchange with the effluent gas stream from the gas generator, as previously described. By this means, the sensible heat in a stream of effluent gas from the gas generator may be used to produce superheated steam in a comparatively clean environment.

The raw effluent gas stream leaving the second heat exchange zone 23 may comprise in mole % $H_2$ 70 to 10, CO 15 to 57, $CO_2$ 0 to 5, $H_2O$ 0 to 20, $N_2$ 0 to 75, A 0 to 1.0, $CH_4$ 0 to 25, $H_2S$ 0 to 2.0, and COS 0 to 0.1. Unreacted particulate carbon (on the basis carbon in the feed by weight) may be about nil to 20 weight percent. A portion of the raw effluent gas stream may be used as the heat transfer fluid. Optionally, at least a portion of the raw effluent gas steam may be cleaned and purified by conventional means to remove unwanted constituents. At least a portion of this product gas may be used as the heat transfer fluid. For example, mixtures of $H_2$+CO having the following composition in mole % may be produced: $H_2$ 10 to 48, CO 15 to 48, and the remainder $N_2$+A. Further, substantially pure $H_2$ i.e. 98 mole % or more for use as the heat transfer fluid may be prepared from the effluent gas stream by well known gas cleaning and purification techniques, including the water-gas shift reaction.

The heat transfer fluid circulated between heat exchangers 16 and 55 may be either in a gaseous or liquid state, and may be selected from the group $H_2O$, helium, nitrogen, argon, hydrogen, and mixtures comprising $H_2$+CO. Alternately, the heat transfer fluid may be selected from the group consisting of sodium, potassium, mercury, and sulphur in gaseous or liquid state so that the heat transfer fluid may be compressed or pumped depending on the operating conditions of temperature and pressure and the phase of the heat transfer fluid. Cooling a heat transfer fluid in the later group to below its solidification temperature is therefore avoided.

In another embodiment, the heat transfer fluid may change state during the heat exchange. For example, in heat exchanger 16 a heat transfer fluid in liquid phase may be converted to the vapor phase. Then in heat exchanger 55, the heat transfer fluid may be condensed back into the liquid phase, which is then pumped into heat exchanger 16.

Conventional shell and tube type heat exchangers may be used in the subject process. The two separate streams passing in heat exchange with each other may be passed in the same or opposite directions. Either stream may be passed through the tubes while the other may be passed on the shell side. By properly insulating the lines, gas generator 1, and heat exchangers 16, 23, and 55, the temperature drop between the pieces of equipment may be kept very small i.e. less than 10° F. Heat resistant metals and refractories are used as construction materials. Heat exchangers 16 and 23 are preferably separate heat exchangers that are joined together. The advantages of this construction will be discussed below in connection with FIG. 1. In another embodiment, heat exchange zones 1 and 2 may be contained in a common shell.

DESCRIPTION OF THE DRAWING

A more complete understanding of the invention may be had by reference to the accompanying schematic drawing which shows the two embodiments of the previously described process in detail. All of the lines and equipment are preferably insulated to minimize heat loss.

Referring to the figures in the drawing in FIG. 1, free-flow noncatalytic partial oxidation gas generator 1 lined with refractory 2 as previously described has an upstream axially aligned flanged inlet port 3, a downstream axially aligned flanged outlet port 4, and a unpacked reaction zone 5. Annulus type burner 6, as previously described, with center passage 7 in alignment with the axis of gas generator 1 is mounted in inlet port 3. Center passage 7 has an upstream inlet 8 and a converging conical shaped downstream nozzle 9 at the tip of the burner. Burner 6 is also provided with concentric coaxial annulus passage 10 that has an upstream inlet 11 and a downstream conical shaped discharge passage 12. Burners of other design may also be used.

Connected to outlet port 4 is the flanged inlet 15 of a shell and tube high temperature heat exchanger 16 of conventional design, having internal tubes or multiple-coils 17, a shell side 20, and a downstream flanged outlet 21. Optionally, a free-flow solids or slag separator (not shown in the drawing) which produces little or no pressure drop may be inserted in the line between outlet 4 of gas generator 1 and inlet 15 of heat exchanger 16. Connected to outlet 21 of heat exchanger 16 is the upstream flanged inlet 22 of shell and tube gas cooler 23, of conventional design, having internal tubes 24, shell side 25, and a downstream flanged outlet 26.

A continuous stream of hydrocarbonaceous feed in liquid or vapor form or pumpable slurries of a solid carbonaceous fuel, as previously described, may be introduced into the system by way of line 30, and optionally mixed with a continuous stream of superheated steam from line 31 or a stream of saturated steam from line 53 in a mixer (not shown). The feed mixture is then passed through line 33, inlet 11, annulus passage 10, and discharge passage 12 of burner 6 into reaction zone 5 of partial oxidation gas generator 1.

Simultaneously, a continuous stream of free-oxygen containing gas as previously described, from line 34 is passed through center passage 7 and nozzle 9 of burner 6 into reaction zone 5 of gas generator 1 in admixture with said hydrocarbonaceous fuel and steam.

The continuous stream of effluent gas leaving partial oxidation gas generator by way of outlet 4 is passed through heat exchanger 16 in non-contact indirect heat exchange with a counterflowing stream of steam produced in gas cooler 23. For example, the steam passing upwardly on the shell side 20 of heat exchanger 16 (also called superheater 16) is converted into superheated steam which exits by way of outlet 38, line 39, valve 41, line 31, and mixed with the hydrocarbonaceous fuel from line 30 in line 33. Optionally, a stream of superheated steam may be withdrawn from superheater 16 by way of line 42, valve 43, line 44, and introduced into a steam turbine as the working fluid.

The partially cooled effluent gas stream leaves superheater 16 through outlet 21 and enters waste heat boiler 23 by way of inlet 22. In passing down through gas cooler 23, the effluent gas stream passes in noncontact indirect heat exchange with a counterflowing stream of boiler feed water. The boiler feed water is thereby heated to produce steam by absorbing at least a portion of the remaining sensible heat in the effluent gas stream. Thus, the boiler-feed water in line 45 enters heat exchanger 23 through inlet 46. It passes up on shell side 25, and leaves through outlet 47 and line 48 as steam. The steam enters superheater 16 through inlet 49 and is converted into superheated steam as previously described. Optionally, a portion of the steam is removed from gas cooler 23 by way of outlet 50, line 51, valve 52, and line 53. This steam may be used elsewhere in the system.

The cooled effluent gas stream leaves gas cooler 23 by way of bottom outlet 26, line 54, and may be sent to conventional gas cleaning and purification zones downstream.

Referring to FIG. 2 in the drawing, the process equipment is similar to that previously described with the exception of an additional shell and tube heat exchanger 55 containing bottom flanged inlet 56, top flanged outlet 57, internal tubes or coils 58, shell side 59, and side outlet 60. From line 61, circulator 62 i.e. pump, compressor, or blower circulates gaseous or liquid heat transfer fluid through line 63, inlet 64, up through shell side 20 in heat exchanger 16, outlet 65, line 66, and inlet 67 of heat exchanger 55 (also called superheater 55). The hot heat transfer fluid then passes down through shell side 59 and out through bottom outlet 60 for recirculation to heat exchanger 16 and reheating.

Operation of the embodiment of the process shown in FIG. 2 is somewhat similar to that previously described in FIG. 1. However, the main differences pertain to employing a heat transfer fluid which is circulated between heat exchangers 16 and 55. In heat exchanger 16, the stream of heat transfer fluid is heated by absorbing a portion of the sensible heat in the effluent gas stream directly from gas generator 1 or directly from a solids and slag separator (not shown in the drawing). As previously described, the stream of heat transfer fluid in heat exchanger 16 passes up through shell side 20 in noncontact indirect heat exchange with the down-flowing continuous stream of hot effluent gas from gas generator 1 in tubes 17. Then in heat exchanger 55, the amount of sensible heat given up by the stream of heat transfer fluid continuously passing down through shell side 59 is sufficient to raise the continuous stream of steam with which it passes in noncontact indirect heat exchange into superheated steam. The steam was previously produced in waste heat boiler 23 by passing boiler feed water in line 45 through inlet 46 and shell side 25 thereby absorbing at least a portion of the sensible heat remaining in the downflowing effluent gas stream in tubes 24 which leaves by outlet 26 and line 54, as described previously for FIG. 1. At least a portion of the steam produced in gas cooler 23 is introduced into superheater 55 by way of outlet 47, line 48 and flanged inlet 56. Optionally, superheated steam from line 39 or steam from line 53 may be introduced into gas generator 1 as a temperature moderator and as a transport medium for the hydrocarbonaceous fuel. Preferably, the effluent gas stream is passed through the tubes in heat exchangers 16 and 23 connected in series.

EXAMPLES

The following examples illustrate embodiments of the process of this invention pertaining to continuously producing by-product superheated steam during the partial oxidation of a hydrocarbonaceous fuel to produce a continuous stream of raw synthesis gas. While preferred modes of operation are illustrated, the examples should not be construed as limiting the scope of the invention. The process is continuous and the quantities specified are on an hourly basis for all streams of materials.

EXAMPLE I

The embodiment of the invention represented by Example I is depicted in FIG. 1 of the drawing as previously described. 3,354,958 standard cubic feet (SCF) of raw synthesis gas are continuously produced in a free-flow noncatalytic gas generator by partial oxidation of a hydrocarbonaceous fuel to be further described with oxygen (about 99.7 volume percent purity). The hydrocarbonaceous fuel is a pumpable slurry comprising 1,036 pounds of particulate carbon recovered later by cleaning the raw synthesis gas product and 57,300 pounds of reduced crude oil having the following ultimate analysis in Wt. %: C 85.87, $H_2$ 11.10, S 2.06, $N_2$ 0.78, $O_2$ 0.16, and ash 0.04. Further the reduced crude oil has an API gravity of 12.5, a heat of combustion of 18,333 BTU per pound, and a viscosity of 479 Saybolt Seconds Furol at 122° F.

About 28,650 pounds of superheated steam produced subsequently in the process at a temperature of 750° F. and a pressure of about 600 psia are mixed with said reduced crude oil to produce a feed mixture having a temperature of about 583° F. which is continuously introduced into the annulus passage of an annulus-type burner and which discharges into the reaction zone of said gas generator. About 744,062 SCF of oxygen at a temperature of about 500° F. are continuously passed through the center passage of said burner and mixed with the dispersion of superheated steam and crude oil.

Partial oxidation and related reactions take place in the free-flow reaction zone of the gas generator to produce a continuous effluent stream of raw synthesis gas at a temperature of 2,380° F. and a pressure of 415 psia. The effluent stream of hot raw synthesis gas from the gas generator passes through a separate heat exchanger or superheater where it is cooled to a temperature of 2,055° F. by heat exchange with a continuous stream of saturated steam produced subsequently in the process. 144,798 lbs. of saturated steam enter the superheater at a temperature of 488° F. and a pressure of 610 psia. About 144,798 lbs. of superheated steam leave the superheater at a temperature of 750° F. and a pressure of 600 psia. As previously described, a portion of this continuous stream of superheated steam is introduced into the gas generator, preferably in admixture with the crude oil. Optionally, a portion of the superheated steam is used as the working fluid in a turbocompressor for example in an air separation plant for producing the free-oxygen feed to the gas generator.

The partially cooled stream of raw synthesis gas leaving the superheater is then passed through the tubes of a separate conventional gas cooler and cooled to a temperature of about 520° F. by heat exchange with 144,798 lbs. of boiler feed water supplied in a continuous stream on the shell side. A stream of about 144,798 lbs. of said by-product saturated steam is thereby produced at a temperature of about 488° F. and a pressure of about 610 psia. As previously described, at least a portion of this saturated steam is passed into the superheater for conversion into superheated steam. The remainder of the saturated steam may be used elsewhere in the process, for example to preheat the free-oxygen containing gas.

The continuous effluent stream of raw synthesis gas leaving said gas cooler after heat exchange with said boiler feed water is at a pressure which is substantially the same as that in the reaction zone of the gas generator less ordinary pressure drop in the lines and heat exchangers. This pressure drop may be less than about 20 psia. The composition of the stream of raw synthesis gas leaving the gas cooler is as follows: $H_2$ 41.55%, CO 41.59%, $CO_2$ 4.61%, $H_2O$ 11.46%, $H_2S$ 0.40%, COS 0.02%, $CH_4$ 0.13%, $N_2$ 0.21%, and A 0.03%. About 1,045 pounds of unconverted particulate carbon are entrained in the effluent stream of raw synthesis gas. Particulate carbon and other gaseous impurities may be removed from the raw synthesis gas in downstream gas cleaning and purifying zones. Optionally, a portion of said superheated steam may be mixed with the synthesis gas stream and then subjected to water-gas shift to convert carbon monoxide in the gas stream to hydrogen and carbon dioxide. The $CO_2$ may be then removed to produce a gas stream comprising hydrogen.

EXAMPLE II

The embodiment of the invention represented by Example II is depicted in FIG. 2 of the drawing, as previously described.

The type and amounts of materials fed to the free-flow noncatalytic gas generator in Example II are substantially the same as those previously described for Example I. Similarly, the composition and amount of raw synthesis gas, and the amounts of saturated steam and superheated steam produced are substantially the same in Examples I and II. Further, the operating temperature and pressures in the gas generator and related heat exchangers, and for the related streams of materials and products are substantially the same in both examples.

In Example II, 20,619 lbs. of hydrogen are cycled continuously between heat exchanger 16 and separate superheater 55 as the heat transfer fluid.

The continuous effluent stream of raw synthesis gas from the gas generator at a temperature of 2,380° F. and a pressure of 415 psia is reduced to a temperature of 2,055° F. by heat exchange with said heat transfer fluid which enters separate heat exchanger 16 at a temperature of 850° F. and leaves at a temperature of 1,482° F. The temperature of the continuous stream of raw synthesis gas is then reduced further to 520° F. by heat exchange with boiler feed water in gas cooler 23. A continuous stream of saturated steam produced in gas cooler 23 at a temperature of 488° F. is then converted into a continuous stream of superheated steam at a temperature of 750° F. and a pressure of 600 psia in separate superheater 55 by noncontact heat exchange with said heat transfer fluid which enters superheater 55 at a temperature of 1,482° F. and leaves at a temperature of 850° F.

The process of the invention has been described generally and by examples with reference to materials of particular compositions for purposes of clarity and illustration only. It will be apparent to those skilled in the art from the foregoing that various modifications of the process and materials disclosed herein can be made without departure from the spirit of the invention.

We claim:

1. In the process for producing gaseous mixtures comprising $H_2$, CO and containing at least one member of the group $H_2O$, $CO_2$, $H_2S$, COS, $CH_4$, $N_2$, A and particulate carbon, by the partial oxidation of a hydrocarbonaceous fuel, or liquid oxygenated hydrocarbonaceous fuel, or a slurry of solid carbonaceous fuel and water or a liquid hydrocarbon with a free-oxygen containing gas and optionally in the presence of a temperature moderator, at a temperature in the range of about 1500° to 3500° F and a pressure in the range of about 1 to 250 atmospheres absolute in the reaction zone of a free-flow noncatalytic gas generator, the improvement comprising: (1) continuously passing the effluent gas stream leaving the reaction zone of said gas generator through a first heat exchange zone in noncontact heat exchange with a continuous stream of steam produced subsequently in the process in step (3) thereby converting said steam into a continuous stream of superheated steam while simultaneously reducing the temperature of the continuous stream of effluent gas; (2) removing a continuous stream of said superheated steam from (1) as a by-product stream; (3) continuously passing the stream of effluent gas leaving the first heat exchange zone in (1) directly into a second heat exchange zone where it passes in noncontact heat exchange with a stream of water, thereby converting said water into a continuous stream of steam, while simultaneously reducing the temperature of the continuous stream of effluent gas; (4) removing a stream of raw effluent product gas; and (5) introducing at least a portion of the stream of steam from (3) into the first heat exchange zone in (1) as said steam.

2. The process of claim 1 wherein the stream of steam from step (5) is introduced into the first heat exchange zone in step (1) at a temperature in the range of about 298° to 705° F. and a pressure in the range of about 65 to 3800 psia and is converted into said stream of superheated steam at a temperature in the range of about 750° to 1100° F. and a pressure in the range of about 65 to 3800 psia.

3. The process of claim 1 wherein the pressure of the steam produced in step (5) and the pressure of the superheated steam produced in step (1) are each greater than the pressure in the reaction zone of the gas generator.

4. The process of claim 1 wherein the first heat exchange zone in step (1) and the second heat exchange zone in step (3) are shell and tube type heat exchangers, and the effluent gas stream from said gas generator is serially passed through the tubes of said heat exchangers in steps (1) and (3) while simultaneously water is converted into steam while being passed through the shell side of the heat exchanger in step (3), and said steam is then converted into superheated steam while being passed through the shell side of the heat exchanger in step (1).

5. The process of claim 1 wherein said first and second heat exchange zones comprise two separate heat exchangers connected in series.

6. The process of claim 1 wherein at least a portion of the superheated steam from step (2) is introduced as the working fluid into a steam turbine for producing mechanical work or electrical energy.

7. The process of claim 1 wherein at least a portion of the superheated steam from step (2) is introduced into the reaction zone of said gas generator.

8. The process of claim 6 wherein said superheated steam is a carrier for said hydrocarbonaceous fuel feed to the gas generator.

9. The process of claim 1 wherein at least a portion of the superheated steam from step (2) is used as the working fluid in a steam turbine used to compress air feed to an air separation unit thereby producing oxygen (95 mole % or more) for reacting in said gas generator.

10. The process of claim 1 provided with the additional step of removing at least a portion of unwanted solid matter from the group particulate carbon, ash, slag, scale, refractory, and mixtures thereof entrained in the effluent gas stream leaving the gas generator or flowing from the gas generator prior to introducing said gas stream into said first heat exchange zone.

11. The process of claim 1 wherein the effluent gas stream leaving said second heat exchange zone is at substantially the same pressure as in the reaction zone of said gas generator less ordinary pressure drop across any solids or slag separation zone, said first and second heat exchange zones, and in the lines.

12. The process of claim 1 wherein the reaction zone in said gas generator, and said first and second heat exchange zones are located in three separate vessels.

13. The process of claim 1 wherein said first and second heat exchange zones are contained within a common shell.

14. The process of claim 1 wherein the free-oxygen containing gas is selected from the group consisting of air, oxygen-enriched air (more than 21 mole % $O_2$) and substantially pure oxygen (more than 95 mole % $O_2$).

15. The process of claim 1 wherein said hydrocarbonaceous fuel is a liquid hydrocarbon selected from the group consisting of liquefied petroleum gas, petroleum distillates and residues, gasoline, naphtha, kerosine, crude petroleum, asphalt, gas oil, residual oil, tar-sand oil, shale oil, coal derived oil, aromatic hydrocarbons such as benzene, toluene, xylene fraction, coal tar, cycle gas oil from fluid-catalytic-cracking operation, furfural extract of coker gas oil, and mixtures thereof.

16. The process of claim 1 wherein said hydrocarbonaceous fuel is a gaseous hydrocarbon.

17. The process of claim 1 wherein said hydrocarbonaceous fuel is an oxygenated hydrocarbonaceous organic material selected from the group consisting of carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

18. The process of claim 1 wherein said hydrocarbonaceous fuel is a pumpable slurry of solid carbonaceous fuel selected from the group consisting of coal, lignite, particulate carbon, petroleum coke, and concentrated sewer sludge and mixtures thereof, in a vaporizable carrier such as water, liquid hydrocarbon and mixtures thereof.

19. The process of claim 1 further provided with the step of preheating the hydrocarbonaceous fuel to a temperature up to about 800° F. but below its cracking temperature with at least a portion of the steam produced in steps (1) and (3) prior to introducing said fuel into the gas generator in step (1).

20. The process of claim 1 provided with the additional steps of cleaning and purifying the stream of raw effluent product gas from step (4).

21. In the process for producing gaseous mixtures comprising $H_2$, CO and containing at least one member of the group $H_2O$, $CO_2$, $H_2S$, COS, $CH_4$, $N_2$, A and particulate carbon, by the partial oxidation of a hydrocarbonaceous fuel, a liquid oxygenated hydrocarbonaceous fuel, or a slurry of solid carbonaceous fuel and water or a liquid hydrocarbonaceous fuel with a free-oxygen containing, gas, and optionally in the presence of a temperature moderator, at a temperature in the range of about 1500° to 3500° F and a pressure in the range of about 1 to 250 atmospheres absolute in the reaction zone of a free-flow noncatalytic gas generator the improvement comprising; (1) continuously passing the effluent gas stream leaving the reaction zone of said gas generator through a first heat exchange zone in noncontact heat exchange with a continuous stream of gaseous or liquid heat transfer fluid from step (4) thereby cooling said effluent gas stream while simultaneously heating said heat transfer fluid; (2) continuously passing the partially cooled effluent gas stream from (1) directly through a second heat exchange zone in noncontact heat exchange with a continuous stream of water, thereby converting said water into steam, while simultaneously reducing the temperature of the continuous stream of effluent gas; (3) removing the stream of raw effluent product gas; (4) simultaneously with step (2) continuously introducing the hot stream of heat transfer fluid leaving the first heat exchange zone in step (1) into a third heat exchange zone where it is cooled by heat exchange with a stream of said steam from step (2), thereby converting said steam into a continuous stream of superheated steam; and (5) removing said stream of superheated steam from step (4) as a continuous by-product stream.

22. The process of claim 21 wherein the stream of heat transfer fluid from step (4) is introduced into the first heat exchange zone in step (1) at a temperature in the range of about 850° to 2200° F. and cools said effluent gas stream to a temperature in the range of about 600° to 2600° F. while simultaneously said heat transfer fluid is heated to a temperature in the range of about 1800° to 2800° F.; said water in step (2) is converted into steam at a temperature in the range of about 298° to 705° F. and a pressure in the range of about 65 to 3800 psia while simultaneously reducing the temperature of said effluent gas stream to a value in the range of about 320° to 700° F.; and the steam in step (4) is converted into superheated steam at a temperature in the range of about 750° to 1100° F. and a pressure in the range of about 65 to 3800 psia by cooling said heat transfer fluid to a temperature in the range of about 850° to 2200° F.

23. The process of claim 21 wherein the first heat exchange zone in step (1) and the second heat exchange zone in step (2) are shell and tube type heat exchangers, and the effluent gas stream from said gas generator is passed through the tubes of said heat exchangers in steps (1) and (2), while simultaneously said water in step (2) is converted into steam while being passed through the shell side of the heat exchanger in step (2), and said heat transfer fluid is heated while being passed through the shell side of the heat exchanger in step (1).

24. The process of claim 23 wherein the third heat exchange zone in step (4) is also a shell and tube type heat exchanger, and the steam produced in step (2) is passed through the tubes of the heat exchangers in step (4) and converted therein into superheated steam, while simultaneously said heat transfer fluid is cooled by being passed through the shell side of the heat exchanger in step (4).

25. The process of claim 21 wherein the pressure of the steam produced in step (2) and the pressure of the superheated steam produced in step (4) are each greater than the pressure in the reaction zone of the gas generator.

26. The process of claim 21 wherein the pressure of the effluent product gas stream leaving step (3) is substantially the same as that in the reaction zone of the gas generator less ordinary pressure drop in the lines plus said first and second heat exchange zones and any solids or slag separation zone.

27. The process of claim 21 provided with the additional steps of cleaning and purifying at least a portion of the raw effluent product gas from step (3) and using at least a portion of the resulting gas mixture in the subject process as said heat transfer fluid.

28. The process of claim 21 wherein said heat transfer fluid is selected from the group consisting of $H_2O$, helium, nitrogen, argon, hydrogen, and mixtures of $H_2+CO$.

29. The process of claim 21 provided with the additional steps of obtaining hydrogen from the raw effluent product gas from step (3) by cleaning, water-gas shift, and purifying; and using at least a portion of said hydrogen in the subject process as said heat transfer fluid.

30. The process of claim 21 wherein said heat transfer fluid is selected from the group consisting of sodium, potassium, mercury, and sulphur.

31. The process of claim 21 wherein said heat transfer fluid leaves step (1) as a vapor, and provided with the steps of condensing said vapor into a liquid in said third heat exchange zone, and pumping said liquid heat exchange fluid into said first heat exchange zone in step (1) as said heat transfer fluid.

32. The process of claim 21 wherein said first and second heat exchange zones comprise two separate shell and tube heat exchangers with the tubes of the first heat exchanger being connected in series to the tubes of the second heat exchanger.

33. The process of claim 21 wherein at least a portion of the superheated steam from step (5) is introduced as the working fluid into a steam turbine for producing mechanical work or electrical energy.

34. The process of claim 21 wherein at least a portion of the superheated steam from step (5) is introduced into the reaction zone of said gas generator.

35. The process of claim 21 wherein said superheated steam is a carrier for said hydrocarbonaceous fuel feed to the gas generator.

36. The process of claim 21 wherein at least a portion of the superheated steam from step (5) is used as the working fluid in a steam turbine used to compress air feed to an air separation unit thereby producing oxygen (95 mole % or more) for reacting in said gas generator.

37. The process of claim 21 wherein the reaction zone in said gas generator, and said first, second, and third heat exchange zones are located in four separate vessels.

38. The process of claim 21 wherein said first and second heat exchange zones are contained within a common shell.

39. The process of claim 21 provided with the additional step of removing at least a portion of unwanted solid matter from the group particulate carbon, ash, slag, scale, refractory, and mixtures thereof entrained in the effluent gas stream leaving the gas generator or flowing from the gas generator prior to introducing said gas stream into said first heat exchange zone.

40. The process of claim 21 wherein the free-oxygen containing gas is selected from the group consisting of air, oxygen-enriched air (more than 21 mole % $O_2$) and substantially pure oxygen (more than 95 mole % $O_2$).

41. The process of claim 21 wherein said hydrocarbonaceous fuel is a liquid hydrocarbon selected from the group consisting of liquefied petroleum gas, petroleum distillates and residues, gasoline, naphtha, kerosine, crude petroleum, asphalt, gas oil, residual oil, tar-sand oil, shale oil, coal derived oil, aromatic hydrocarbons such as benzene, toluene, xylene fraction, coal tar, cycle gas oil from fluid-catalytic-cracking operation, furfural extract of coker gas oil, and mixtures thereof.

42. The process of claim 21 wherein said hydrocarbonaceous fuel is a gaseous hydrocarbon.

43. The process of claim 21 wherein said hydrocarbonaceous fuel is an oxygenated hydrocarbonaceous organic material selected from the group consisting of carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

44. The process of claim 21 wherein said hydrocarbonaceous fuel is a pumpable slurry of solid carbonaceous fuel selected from the group consisting of coal, lignite, particulate carbon, petroleum coke, and concentrated sewer sludge and mixtures thereof, in a carrier such as water, liquid hydrocarbon and mixtures thereof.

45. The process of claim 21 further provided with the step of preheating the hydrocarbonaceous fuel to a temperature up to about 800° F. but below its cracking temperature with at least a portion of the steam produced in steps (2) and (4) prior to introducing said fuel into the gas generator in step (1).

* * * * *